US008852402B2

(12) United States Patent
Imppola et al.

(10) Patent No.: US 8,852,402 B2
(45) Date of Patent: Oct. 7, 2014

(54) METHOD FOR PRODUCING CALCIUM CARBONATE DURING FORMATION OF A FIBROUS WEB

(75) Inventors: Olavi Imppola, Hyvinkaa (FI); Esko Kukkamaki, Kangasala (FI); Jouni Matula, Savonlinna (FI); Paivi Solismaa, Lappeenranta (FI)

(73) Assignees: Wetend Technologies Oy, Savonlinna (FI); UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 13/608,833

(22) Filed: Sep. 10, 2012

(65) Prior Publication Data

US 2013/0062030 A1 Mar. 14, 2013

Related U.S. Application Data

(63) Continuation-in-part of application No. PCT/FI2011/050203, filed on Mar. 9, 2011.

(30) Foreign Application Priority Data

Mar. 10, 2010 (FI) ..... 20105232

(51) Int. Cl.
*D21H 17/70* (2006.01)
*D21H 17/67* (2006.01)

(52) U.S. Cl.
CPC ..... *D21H 17/70* (2013.01); *D21H 17/675* (2013.01)
USPC ..... 162/181.2; 162/181.4; 162/182; 162/192

(58) Field of Classification Search
CPC ..... D21H 17/675; D21H 17/67; D21H 17/70; D21H 17/63; D21H 17/73; D21H 11/10; D21H 11/14; D21H 21/02
USPC ..... 162/9, 63, 70, 181.1–181.2, 181.4, 182, 162/183, 192; 422/22, 129, 186
See application file for complete search history.

(56) References Cited

U.S. PATENT DOCUMENTS 4,073,712 A * 2/1978 Means et al. ..... 204/554
5,223,090 A * 6/1993 Klungness et al. ..... 162/9

(Continued)

FOREIGN PATENT DOCUMENTS

DE 10 2006 0003647 A1 1/2007
EP 1481724 A1 * 12/2004 ..... B01J 19/00

(Continued)

OTHER PUBLICATIONS

W.L. Cho et al. "The Use of Scalewatcher Electronic Water Treatment in the Reduction of Scale in Pulp and Paper Applications", 83rd Annual Meeting, Technical Section CPPA, pp. B453-B456, 1997.

(Continued)

*Primary Examiner* — Jose Fortuna
(74) *Attorney, Agent, or Firm* — Nixon & Vanderhye P.C.

(57) ABSTRACT

A method for production of calcium carbonate in a target suspension of a fibrous web forming process of a fibrous web machine, wherein the calcium carbonate is produced in a reactor, the method includes: injecting a chemical including carbon dioxide or lime milk through an injection mixer to the target suspension flowing through the reactor; allowing the chemical including to react while in the target suspension to form calcium carbonate crystals, and inhibiting precipitation of the chemical or a reaction product of the chemical on a surface of or in the reactor by application of an electric or magnetic field to or proximate to the surface along a region of the surface adjacent to the reaction involving the chemical.

12 Claims, 8 Drawing Sheets

(56) References Cited

U.S. PATENT DOCUMENTS

| | | | | | |
|---|---|---|---|---|---|
| RE35,460 | E * | 2/1997 | Klungness et al. | 162/9 |
| 5,670,041 | A * | 9/1997 | Cho et al. | 210/222 |
| 5,679,220 | A * | 10/1997 | Matthew et al. | 162/181.4 |
| 5,702,600 | A * | 12/1997 | Pandolfo | 210/222 |
| 5,731,080 | A * | 3/1998 | Cousin et al. | 428/372 |
| 5,759,349 | A * | 6/1998 | Foster et al. | 162/158 |
| 6,063,267 | A * | 5/2000 | Crewson et al. | 210/143 |
| 6,210,533 | B1 * | 4/2001 | Doelle | 162/246 |
| 6,355,138 | B1 * | 3/2002 | Doelle | 162/9 |
| 6,413,365 | B1 * | 7/2002 | Doelle et al. | 162/9 |
| 6,458,241 | B1 * | 10/2002 | Doelle et al. | 162/9 |
| 6,471,825 | B1 * | 10/2002 | Doelle et al. | 162/9 |
| 6,503,466 | B1 * | 1/2003 | Doelle et al. | 422/229 |
| 6,533,895 | B1 * | 3/2003 | Doelle et al. | 162/9 |
| 6,537,425 | B2 * | 3/2003 | Rheims et al. | 162/181.4 |
| 6,599,390 | B2 * | 7/2003 | Rheims et al. | 162/9 |
| 6,623,599 | B1 * | 9/2003 | Laurila-Lumme et al. | 162/8 |
| 6,627,042 | B2 * | 9/2003 | Holik | 162/123 |
| 6,659,636 | B1 * | 12/2003 | Matula | 366/165.1 |
| 6,673,211 | B2 * | 1/2004 | Doelle | 162/261 |
| 6,733,629 | B1 * | 5/2004 | Matula | 162/190 |
| 6,755,941 | B2 * | 6/2004 | Rheims et al. | 162/241 |
| 6,881,298 | B2 * | 4/2005 | Rheims et al. | 162/9 |
| 6,939,438 | B2 * | 9/2005 | Doelle | 162/9 |
| 7,169,258 | B2 * | 1/2007 | Rheims et al. | 162/9 |
| 7,234,857 | B2 * | 6/2007 | Matula | 366/167.1 |
| 7,264,689 | B2 * | 9/2007 | Doelle | 162/9 |
| 7,524,413 | B2 * | 4/2009 | Wittmer et al. | 210/143 |
| 7,758,725 | B2 * | 7/2010 | Matula | 162/185 |
| 8,202,397 | B2 * | 6/2012 | Matula | 162/181.4 |
| 8,480,854 | B2 * | 7/2013 | Kukkamaki et al. | 162/181.2 |
| 8,480,855 | B2 * | 7/2013 | Maijala et al. | 162/243 |
| 2002/0131325 | A1 * | 9/2002 | Matula | 366/165.1 |
| 2003/0094252 | A1 * | 5/2003 | Sundar et al. | 162/128 |
| 2005/0248049 | A1 * | 11/2005 | Gannaway et al. | 264/51 |
| 2006/0196817 | A1 * | 9/2006 | Crewson et al. | 210/223 |
| 2007/0051685 | A1 * | 3/2007 | Wittmer et al. | 210/695 |
| 2007/0119561 | A1 * | 5/2007 | Doelle et al. | 162/181.2 |
| 2007/0169905 | A1 * | 7/2007 | Yamashita et al. | 162/181.2 |
| 2007/0251888 | A1 * | 11/2007 | Matula | 210/752 |
| 2007/0258315 | A1 * | 11/2007 | Matula | 366/134 |
| 2007/0258316 | A1 * | 11/2007 | Matula | 366/160.1 |
| 2008/0210391 | A1 * | 9/2008 | Pfalzer et al. | 162/4 |
| 2008/0230194 | A1 * | 9/2008 | Matula | 162/166 |
| 2009/0229772 | A1 * | 9/2009 | Riou | 162/90 |
| 2009/0236294 | A1 * | 9/2009 | Wittmer et al. | 210/748 |
| 2010/0212853 | A1 * | 8/2010 | Klungness | 162/181.4 |
| 2011/0000633 | A1 * | 1/2011 | Kukkamki et al. | 162/181.2 |
| 2011/0226432 | A1 * | 9/2011 | Matula | 162/164.3 |
| 2013/0000858 | A1 * | 1/2013 | Rasanen et al. | 162/192 |
| 2013/0058186 | A1 * | 3/2013 | Matula | 366/165.1 |
| 2013/0062030 | A1 * | 3/2013 | Imppola et al. | 162/181.4 |
| 2013/0126116 | A1 * | 5/2013 | Solismaa | 162/181.2 |

FOREIGN PATENT DOCUMENTS

| | | | | |
|---|---|---|---|---|
| FR | 2692645 | A1 * | 12/1993 | F16L 58/00 |
| WO | WO 9714654 | A1 * | 4/1997 | C02F 1/48 |
| WO | 9943887 | A1 | 9/1999 | |
| WO | WO 2005032704 | A1 * | 4/2005 | B01J 4/00 |
| WO | 2005121448 | A1 | 12/2005 | |
| WO | WO 2006005795 | A1 * | 1/2006 | |
| WO | WO 2008059006 | A1 * | 5/2008 | D21H 21/02 |
| WO | WO 2009056178 | A1 * | 5/2009 | |
| WO | WO 2009083633 | A1 * | 7/2009 | C01F 11/18 |
| WO | 2009103853 | A2 | 8/2009 | |
| WO | WO 2009117141 | A1 * | 9/2009 | C02F 1/00 |
| WO | WO 2011110744 | A2 * | 11/2011 | |

OTHER PUBLICATIONS

Loraine A. Huchler "Non-Chemical Water Treatment Systems: Histories, Principles and Literature Review", Oct. 2002, 11 pages.
"Magnetic Water Treatment", Wikipedia, Dec. 10, 2010, 3 pages.

* cited by examiner

METHOD FOR PRODUCING CALCIUM CARBONATE DURING FORMATION OF A FIBROUS WEB

RELATED APPLICATIONS

This is a continuation-in-part application based on PCT/FI2011/050203, designating the U.S. and having an international filing date of 9 Mar. 2011, and claiming priority to Finnish Patent Document 20105232 filed 10 Mar. 2010, the entirety of which applications are both incorporated by reference.

BACKGROUND

The present invention relates to a method and a reactor for in-line production of calcium carbonate (PCC) in connection with the production process of a fibrous web. The invention especially relates to in-line production of PCC into a suspension to be used in the production of the fibrous web, especially preferably directly into the flow of fibrous pulp, one of its partial pulp flows or a filtrate flow used in the production of fibrous pulp.

Calcium carbonate is commonly used in papermaking processes as both filler and coating material due to, among others, the high brightness and low cost of carbonate. Calcium carbonate may be produced by grinding from chalk, marble or limestone, which is then called ground calcium carbonate (abbreviated GCC). Another method of producing calcium carbonate is the chemical method, in which e.g. carbonate ions, formed when the calcium ions, the other constituent of calcium hydroxide, and carbon dioxide are dissolved in water, are allowed to react, whereby the formed calcium carbonate is precipitated from the solution as crystals the shape of which depends on e.g. the reaction conditions. The end product of this production method is called PCC, which is an abbreviation of the words precipitated calcium carbonate. This invention concentrates on the production of PCC and its use especially as a filler of paper.

Traditionally, the production of PCC has taken place separate from the actual papermaking. So far, PCC has been produced either at a dedicated plant located near the paper mill, from which the PCC slurry is directed by pumping along pipelines to paper production, or at a corresponding plant from which the PCC is transported by tank trucks to paper mills located farther away. PCC produced by this method requires the use of retention materials in papermaking in order to have the PCC fastened to the fibers, regardless of whether the fibers are produced chemically or mechanically. The use of retention materials naturally causes additional costs to papermaking in the form of acquiring the chemical itself and as precipitation or recyclability problems possibly caused by the chemical. The traditional method of producing PCC briefly described above brings about problems in addition to the problems relating to the use of retention materials. Tank transportation of PCC to the paper mill from the production site causes transport costs and requires the use of dispersing agents and biocides. The use of the additives affects the properties of PCC while still increasing the acquiring and processing costs.

Building a separate PCC plant in connection with the mill is an expensive investment and the operation thereof requires a workforce of several persons 24 hours a day. A PCC plant according to prior art also consumes large amounts of fresh water and energy.

Thus, lately there have been numerous suggestions for producing PCC directly at the paper mill for reducing the production costs of paper, whereby at least the transport costs of PCC are eliminated from the cost structure of paper. It has additionally been noticed that in-line production of PCC in the presence of fiber suspension leads to better fastening of PCC crystals to the fibers, whereby the need for retention materials is at least reduced and in some cases their use may be totally eliminated. In this context in-line production means producing PCC directly to a suspension used in the production of the fibrous web so that PCC or the suspension is not kept in intermediate storage but it is directly used in the production of the fibrous web. Here, suspension broadly means various liquids transporting fibers or fillers from various high-consistency pulp or stock components to different filtrates formed in the production of the fibrous web, such as any filtrate from a fiber recovery filter.

The newest and currently actually the only industrially applicable method of producing PCC is disclosed in patent application WO-A2-2009/103854. This disclosure teaches production of PCC from carbon dioxide and lime milk so that the carbon dioxide and lime milk are mixed very effectively, preferably by using injection mixers, directly into the pulp in the flow pipe transporting the pulp to the headbox of the paper machine. Thereby, due to the efficient mixing, the carbonate ions and the calcium ions are located close to each other and the formation of crystals is very fast. However, test runs relating to the discussed method have shown that in a way typical to crystallization of calcium carbonate, carbonate crystals are also precipitated onto the surface of the flow pipe in addition to fibers and other solid particles of the target suspension. Carbonate is also precipitated on other solid structures, such as the chemical feed apparatuses and various structures of the mixer. Such precipitations are detrimental to papermaking for example in that when released as smaller or larger particles, a carbonate precipitation spoils the end product, causing, e.g. holes and/or spots to the produced paper or disadvantageous changes in the flows of the headbox, reflected as deterioration of the quality of the end product. Another possible disadvantage is the reduction of mixing due to the reduced functionality caused by the precipitation of carbonate in the feed and/or mixing apparatuses of the chemicals.

The precipitation problems of calcium carbonate are, however, previously known per se. Now, however, the problems have been emphasized when using the injection mixers described in, e.g. patent publications EP-B1-1064427, EP-B1-1219344, FI-B-111868, FI-B-115148 and FI-B-116473 for in-line production of PCC as described in the above-mentioned publication WO-A2-2009/103854. The reason for the increase of problems is that as the injection mixers may mix carbon dioxide and lime milk very fast and evenly into the flow, the duration of the whole crystallization reaction of calcium carbonate is very short. Due to this, a large amount of calcium carbonate in crystallization phase is simultaneously near the wall of the flow pipe so that when said chemicals form a solids crystal it is fastened to the wall of the flow pipe, or in a broader sense, any solid structure being in connection with the flow pipe, and not to another solid material, such as a fiber or a filler particle. Previously, carbon dioxide and lime milk were fed with less powerful mixers, whereby it took the chemicals tens of seconds, sometimes even minutes, to react with another, whereby the carbonate precipitations formed on the inside surface of the flow pipe were distributed on an essentially longer distance of the flow pipe. In other words, while previously precipitations were distributed along the entire length of the short circulation of the paper machine after the introduction point, often to a length of tens of meters, now the precipitations in many cases cover the surface of the flow pipe at a distance of a few meters or even less, measured from the introduction of carbon dioxide and lime milk. In more detail, accumulation of precipitations on the surface of the flow pipe starts at the introduction point of the latter introduced chemical and in practice it ends where at least one chemical has been used up in the crystallization reaction. Because it may be supposed that in the case of both traditional mixing and in mixing using injection mixer essentially the same amount of calcium carbonate is precipitated on the surface of the flow pipe, it is probable that the precipitation layer formed when using injection mixers may in the same period of time be considerably thicker, even many times thicker, than in the traditional mixing method. Simultaneously the risk of the precipitations being broken up and released as fragments to the flow increases and the occurrence rate of problems caused by the fragments may even increase.

SUMMARY OF INVENTION

A novel way is disclosed herein of producing calcium carbonate in a fibrous web machine environment directly into the solids-containing suspension used in the production of the product of the fibrous web machine or the actual fibrous pulp or any other liquid flow of the short circulation or otherwise relating to the fibrous web machine (such as any filtrate of the fiber recycling filter) in a way to be able to reduce or even fully eliminate the problem of prior art.

The reactor disclosed here is well suited for said in-line production of calcium carbonate (PCC) without the risk of carbonate precipitations.

An additional aim of the present invention is to provide a reactor being a part of the approach system of a fibrous web machine or even a part of the approach pipe of the headbox of the fibrous web machine, the reactor comprising both a mixing system for chemicals and means for keeping the reactor clean, the design and operation method of the reactor being dimensioned so that the crystallization reaction of the calcium carbonate essentially fully occurs at the length of the reactor.

Another additional aim of the invention is to locate the reactor used for production of PCC in such a position of the short circulation where either there is no major disadvantage of the PCC fragments fastened on the walls of the reactor and then loosening, or the position of the reactor is optimized with regard to the precipitation of PCC. In other words, the PCC reactor may be positioned in such a location of the short circulation that the particles/fragments loosening into the PCC-loaded suspension travel through at least one sorting stage so that the sorting taking place in them removes the particles/fragments from the suspension so that they do not cause problems in the production of the fibrous web. It is also preferable to position the PCC reactor in connection with a pipe line transporting suspension in which the precipitation of PCC is desirable for the suspension itself (precipitation into the fines of the filtrate for improving its retention) or for the precipitation of the actual PCC.

A method according to an embodiment of the invention for in-line production of calcium carbonate into a target suspension of a fibrous web forming process of a fibrous web machine, the target suspension of the process comprising at least one of the following components: virgin pulp suspension (long-fiber pulp, short-fiber pulp, mechanical pulp, chem-mechanical pulp, chemical pulp, microfiber pulp, nanofiber pulp), recycled pulp suspension (recycled pulp, reject, fiber fraction from the fiber recovery filter), additive suspension and solids-containing filtrate, calcium carbonate being produced in a PCC reactor, the reactor being a part of the flow pipe transporting the target suspension, the method having the steps of:

A. providing the reactor with means for preventing the precipitation of PCC into the reactor or onto the surfaces of apparatuses in connection therewith, i.e. with one of electrodes, a permanent magnet, an electric magnet and a material to which the PCC is incapable of fastening to;

B. introducing at least one of carbon dioxide and lime milk to said target suspension flowing inside the reactor by using at least one injection mixer for mixing said carbon dioxide and lime milk into said target suspension, and C. Allowing said chemicals to react with one another in said reactor for forming calcium carbonate crystals, whereby the preventing means is located in connection with the reactor essentially on a length on which said chemicals react, a so-called reaction zone.

A reactor according to an embodiment of the invention for in-line production of calcium carbonate into a target suspension of a fibrous web forming process of a fibrous web machine, the target suspension of the fibrous web forming process comprising at least one of the following components: virgin pulp suspension (long-fiber pulp, short-fiber pulp, mechanical pulp, chemimechanical pulp, chemical pulp, microfiber pulp, nanofiber pulp), recycled pulp suspension (recycled pulp, reject, fiber fraction from the fiber recovery filter), additive suspension and solids-containing filtrate, is characterized in that the reactor is provided with means for keeping the inside surface of the reactor clean from calcium carbonate precipitations, i.e. with one of electrodes, a permanent magnet, an electric magnet and a material to which PCC is incapable of fastening to; with injection means for introducing and mixing at least carbon dioxide or lime milk into the reactor and into said target suspension, whereby carbon dioxide and lime milk are added into said target suspension flowing in the reactor, said carbon dioxide and lime milk being mixed into said target suspension and said chemicals being allowed to react together in the reactor for forming calcium carbonate crystals.

Other features typical to the method and the reactor according to the invention will become apparent from the appended claims and the following description disclosing the most embodiments of the invention.

The present invention may be used to bring about, among others, the following advantages when e.g. a reactor according to the present invention is dimensioned in longitudinal direction to essentially correspond with the reaction time needed by the carbon dioxide and lime milk (the rate of pipe flow and the reaction time determine the length of the reactor) for producing PCC:

- no precipitations may be formed or fastened to the surface of the flow pipe to reduce the quality of the end product or affect the production thereof,
- washing the pipes to remove the precipitations may be avoided,
- use of various additional chemicals may be either totally avoided or it may be considerably reduced,
- retention of solids is improved,
- precipitation of PCC on solids or fiber may be optimized,
- a full control of conversion by measuring the progress of the reaction,
- short reaction zone—the reactor may be placed even in a short portion of the flow pipe between various process steps,
- a short reactor makes it possible to manufacture the reactor from or coat it with material more expensive than conventional steel, control of the reactor and runnability of the process, reporting is easy to provide by means of the control system, and use of tomography allows providing a number of various alarms, thus considerably facilitating quality control.

SUMMARY OF THE DRAWINGS

In the following the method and the reactor according to the invention and the operation thereof are described in more detail with reference to the appended schematic figures, of which.

DETAILED DESCRIPTION OF THE INVENTION

Figure 1B:
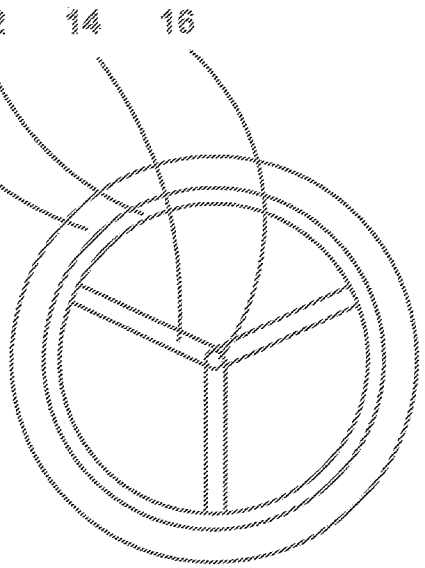
FIGS. 1A and 1B schematically show a reactor according to an embodiment of the invention.
Figure 1A:
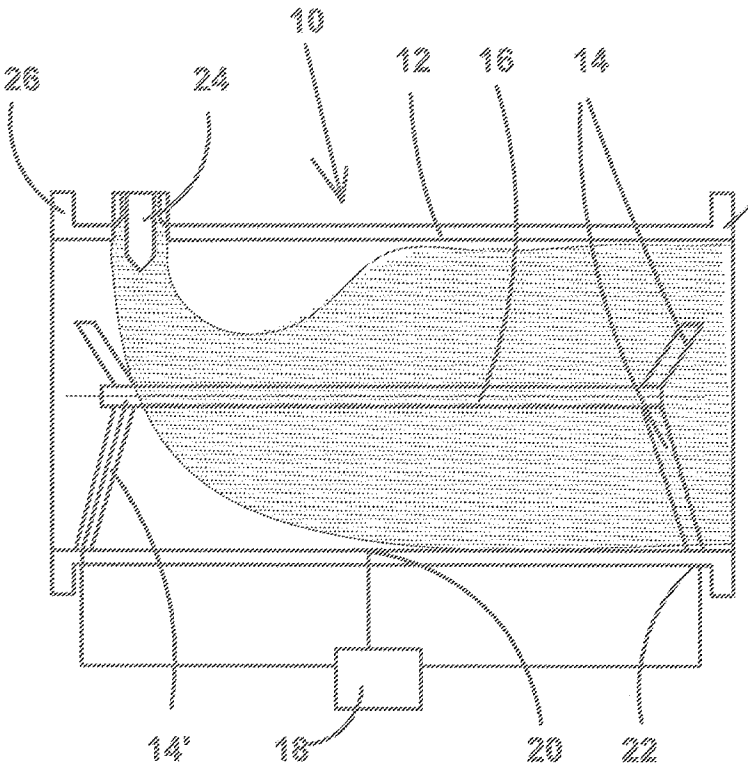

FIGS. 1*a* and 1*b* show relatively schematically a reactor 10 according to an embodiment of the invention. The reactor 10 of FIG. 1 comprises a straight cylindrical flow pipe 12, inside which, at a distance from the inner surface of the wall of the reactor, preferably essentially centrally in the flow pipe, at least one electrically conductive electrode rod 16 is fastened by means of arms 14, the rod being in this embodiment electrically connected via at least one arm 14' to a control system 18 preferably including a suitable voltage source. The electrode rod 16 must be electrically isolated from the flow pipe 12 in case the flow pipe 12 is made of metal, as it in most cases is. This isolation may be carried out by e.g. arranging the fastening arms 14 and 14' of the rod 16 from an electrically non-conductive material or by manufacturing the rod 16 mainly from an electrically non-conductive material and coating the suitable parts thereof with an electrically conductive material. Another electrode 20 is arranged on the inner surface of the flow pipe 12. Said second electrode 20 is, similar to the first one, electrically connected to the voltage source/control system 18 so that the desired voltage difference may be created between the inner surface of the flow pipe 12 and the electrode rod 16 located in the middle of the pipe. Naturally, the simplest solution is that the flow pipe 12 is made of metal, whereby it may act as an electrode 20 in its entirety and no separate electrode is needed. When the flow pipe 12 is made of electrically non-conductive material, there should preferably be a number of said second electrodes 20, most preferably distributed at even intervals both in the direction of the circumference of the pipe 12 and in the longitudinal direction of the reactor 10. Another alternative is to coat the flow pipe internally with an electrically conductive material, whereby said coating acts as the electrode 20.

The third component preferably, but not necessarily, connected to the control system is some type of a measurement sensor 22 for monitoring, among others, the effectiveness of the mixing and/or progress of the reactions in the reactor 10. This sensor may be based on e.g. tomography (here, preferably a tomography measurement based on the electrical conductivity of the fiber suspension) but it may just as well measure the pH value of the pulp or its conductivity. The purpose of the measurement sensor is to monitor the effectiveness of the mixing, the progress of the reaction and/or the cleanness of the surface of the reactor so that e.g. the introduction pressure or volume flow may be adjusted, if necessary. When needed, said measurement sensor and a second measurement sensor in addition to said sensor may be arranged in connection with the electrode rod 16, whereby it is possible to monitor e.g. the propagation of the reaction in the middle of the flow in addition to the vicinity of the surface of the reactor. When needed, the measurement sensor may be arranged to be located at a distance from the actual electrode rod by means of e.g. an arm made of isolating material, i.e. either in the direction of the axis of the reactor, in the direction of the radius of the reactor or in both directions.

The reactor according to the invention additionally comprises an apparatus for feeding chemicals. Its role is especially important because in the production of PCC the amount of introduced chemicals is relatively large. For example, it is often necessary to introduce calcium (as lime milk) so that when using paper pulp as target suspension its concentration in fiber pulp is of the order or >1 g/l. In case the crystallization reaction is carried out into a smaller liquid volume, such as a partial pulp or another target suspension, the concentration of calcium in said partial pulp is naturally higher, sometimes even many times higher than the above-mentioned value. In this description the term target suspension means virgin pulp suspension (long-fiber pulp, short-fiber pulp, mechanical pulp, chem-mechanical pulp, chemical pulp, microfiber pulp, nanofiber pulp), recycled pulp suspension (recycled pulp, reject, fiber fraction from the fiber recovery filter), an additive suspension or a solids-containing filtrate or a combination thereof. In this embodiment of the invention the wall of the flow pipe is provided with at least one of the injection mixers 24 mentioned in the preamble of the description, preferably a TrumpJet® injection mixer developed by Wetend Technologies Oy, by means of which the carbon dioxide and/or lime milk may be quickly introduced and evenly mixed into the target suspension flowing in the flow pipe 12. It is typical to the operation of said injection mixer that the chemical is introduced essentially perpendicular to the flow direction of the process liquid (a direction perpendicular to the flow direction of the process liquid +/−30 degrees) and with a high injecting speed (3 to 12 times) in relation to the flow speed of the process liquid i.e. the target suspension. A typical feature of a version of the injection mixer 24 is that the introduction and mixing of carbon dioxide and lime milk is made with an introduction liquid so that the chemical is brought into contact with the introduction liquid essentially simultaneously when the mixture thereof is injected into the target suspension. When using the injection mixer, the amount of carbon dioxide and lime milk may greatly vary in relation to the amount of introduction liquid, whereby it is possible to use relatively large amounts of introduction liquid, thus making it sure that in some cases even a very small amount of chemicals penetrates deep into the target suspension and is evenly mixed into it. The amounts of carbon dioxide and lime milk introduced are preferably kept stoichiometric, so that essentially the whole amount of chemicals reacts in the reactor and no residue of either chemical remains in the target suspension. A typical feature of another version of the injection mixer is that the at least one chemical to be mixed and the introduction liquid are introduced into each other and, if necessary, mixed together already before the actual introduction apparatus.

In the injection mixer 24, a liquid available from the actual process, solids-containing liquid available from the vicinity of the process, a filler fraction or a fiber suspension may be used as introduction liquid. In other words, the liquid to be used may, for example, be clean water, raw water or a cloudy, clear or super clear filtrate from the process. One alternative worth considering is the use of the target suspension itself or one of its fiber or filler components as the introduction liquid. Using the target suspension as the introduction liquid may be achieved for example by taking a side flow from the flow pipe 12, in which the flow in this embodiment is the target suspension, and then introducing it to the injection mixer 24 by means of a pump.

Another feature of the injection mixer 24 is that the velocity of the jet of introduction liquid and carbon dioxide or lime milk is essentially higher than that of the target suspension, i.e. process liquid, flowing in the flow pipe. Thus, the jet of chemical and introduction liquid penetrates deep into the process liquid flow and is effectively mixed therewith. The relation of flow velocities may vary within a range of 2 to 20, preferably within the range of 3 to 12. Preferably, but not necessarily, it is possible to construct the reactor 10 according to the invention so that all conduits, pipelines, pumps and cleaning means are located inside the pipeline within the length defined by the flanges 26 and 28, whereby the installation of the reactor 10 to the pipeline may naturally be carried out as easily as possible. A structural solution for the operation of the reactor is to position both the electrode rod and the at least one electrode on the circumference of the flow pipe so that their effect extends to both a distance to the upstream side of the reaction zone and the length of the reaction zone. In other words, said electrodes are positioned at least to the same diameter of the flow pipe as the latter chemical introduction points and they extend in the flow direction until the crystallization reaction of the chemicals has practically ended.

In the reactor, the number of the injection mixers used for introducing the one chemical or chemical compound mainly depends on the diameter of the reactor or the flow pipe. When using standard-size TrumpJet®-injection mixers of Wetend Technologies Oy 1 to 6 pieces are needed depending on the diameter of the flow pipe.

FIG. 1*a* shows a situation in which carbon dioxide or lime milk is introduced from the injection mixer 24 into the target suspension flowing to the right in the reactor 10 so that the introduction jet nearly instantaneously penetrates to essentially the whole cross-section of the reactor/flow pipe. Because the introduction takes place by injecting from a nozzle designed for the purpose, the discharged chemical flow is mostly in such small drops or bubbles (when introducing gaseous carbon dioxide) that the mixing of carbon dioxide or lime milk into the target suspension takes place very fast, in practice immediately. At the same time, both the chemicals reacting together as well as the components of the target suspension reacting or otherwise cooperating with the chemical are allowed to contact each other essentially immediately after the injection mixing. In other words, an effectively realized injection mixing ensures that the time needed for the material transfer prior to the reaction is minimal in comparison with traditional mixing methods.

The reactor 10 wall 12 cleaning system according to an embodiment of the invention shown in FIGS. 1*a* and 1*b*, dissolves the existing calcium carbonate precipitations and prevents the forming of new calcium carbonate precipitations by directing a DC voltage to the electrode rod 16 and the electrode 20 in connection with the wall 12 of the reactor through the voltage supply/control system 18 so that the electrode rod 16 acts as a cathode and the wall 12 of the reactor acts as the anode. When the wall 12 is the anode, the pH value of the liquid adjacent the wall 12 is reduced to clearly acid range, to less than 6, preferably to less than 5, most preferably to a value of 2 to 3, thus preventing carbonate from being fastened to the wall 12. In fact, the carbonate crystals are not even allowed to contact the wall as they dissolve in the liquid phase at a low pH. Naturally, the carbonate has a tendency to precipitate on the surface of the electrode rod acting as cathode when the pH is high near said surface. The disadvantages arising from said precipitation tendency are easy to eliminate by programming the control system 18 to change the polarity of the system, whereby the carbonate previously precipitated on the surface acting as the cathode is quickly dissolved in the acid liquid formed near the electrode now acting as the anode. The easiest control method is to program the control system to change polarity at certain intervals (from fractions of a second to minutes or hours) for keeping both electrodes clean. Another way to control the polarity changes is to use a control impulse from the process. It is, for example, possible to monitor the voltage change between the cathode and the anode, whereby a certain increase in voltage in practice means a precipitation layer of a certain depth (the layer acting as isolation). Thus the control system may be calibrated to change the polarity of the system at a certain potential difference. Correspondingly, when said potential difference has been reduced back to its original level or when the potential difference no more changes, the control system returns the polarity back to the original state.

Figure 2:
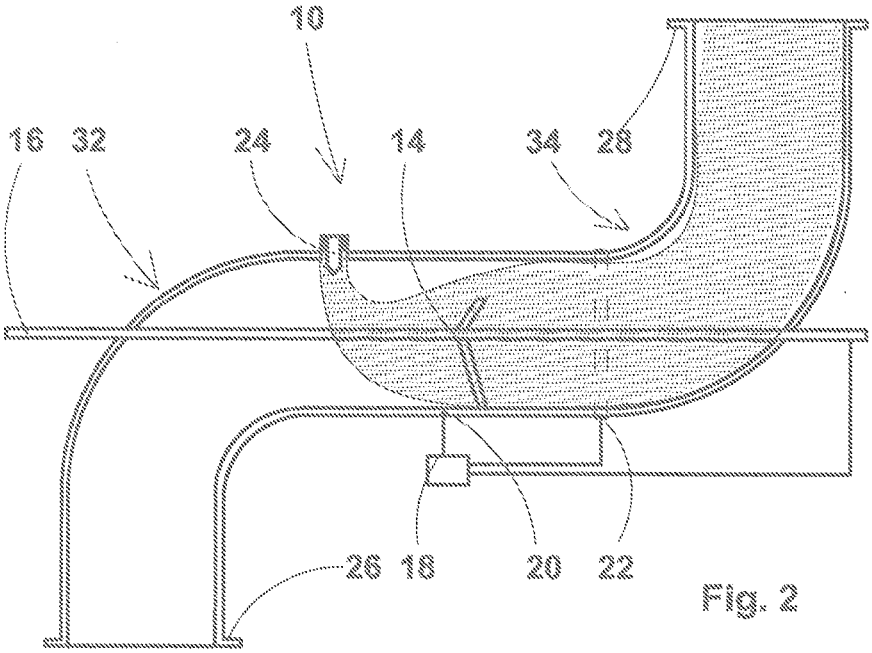
FIG. 2 shows a reactor according to another embodiment of the present invention.

FIG. 2 shows a solution for arranging the reactor according to another embodiment of the invention into the flow pipe. In the solution of the figure the reactor is positioned between two pipe elbows 32 and 34 so that the electrode rod 16 may be supported by its ends to the pipe elbows and to arrange a support by arms 14 only when needed either by one arm arrangement to the middle part of the reactor or by a number of arm arrangements along the electrode rod 16. In this embodiment the support arms 14 of the electrode rod located in the reaction zone of the reactor are preferably either fully made of or at least coated with a material to which the carbonate particles do not fasten to. As the electrode rod 16 extends in the embodiment of the figure to the outside of the pipe elbow 34 of the reactor, the electrode rod may be connected straight to the control unit without the need to direct the conductor via the support arm to the electrode rod inside the reactor. In this case the electrode rod 16 is isolated from the flow pipe, i.e. the reactor 10, whereby the wall of the reactor itself may act as the second electrode. Other parts, instrumentation and operation of the reactor correspond with FIG. 1. Should it be desired to make sure the electrodes on the electrode rod and the surface of the pipe operate as optimally as possible, the portion/portions of the electrode rod located on the area of the pipe elbow may be coated with isolating material. Thus the distance of the electrical surface of the electrode rod from the surface of the pipe is constant along the whole length of the rod and thus also the pH values are even adjacent both electrode surfaces.

Figure 3:
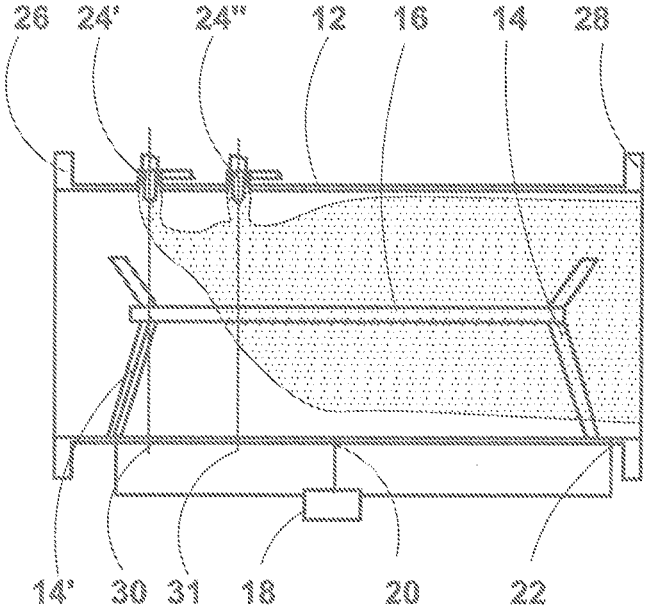
FIG. 3 shows a reactor according to a third embodiment of the present invention.

FIG. 3 shows a reactor according to a third embodiment of the invention. The reactor of FIG. 3 is mainly of the same type as that of FIG. 1, but here the reactor is provided with two injection mixers or mixer stations (a number of mixers mixing the same chemical on essentially the same reactor circumference) 24' and 24" on two successive circumferences of the flow pipe. By means of said mixers 24' and 24" it is possible to ensure the introduction and mixing of carbon dioxide and lime milk to the flowing target suspension considerably more efficiently, quickly and evenly than before. In practice the injection mixers 24' and 24" are positioned so that at least one mixer 24' is located on the first circumference 30 of the reactor and at least one mixer 24" is located on the second circumference 31 of the reactor, correspondingly, at a distance after the circumference of the mixer 24'. The distance between the mixer circumferences 30 and 31 depends, among others, on the flow velocity of the pulp in the reactor, introduction sequence of the chemicals, the introduction velocities of the carbon dioxide and/or lime milk and the introduction liquid, the volume flows of said gases/liquids, the diameter of the reactor, the construction of the injection nozzle, to mention just a few parameters. However, preferably the distance between the circumferences 30 and 31 is of the order of 0.05 to 3 meters, more preferably 0.1 to 1 meters.

The reactor according to FIG. 3, i.e. one having two successive injection mixers/injection mixer stations, is used in in-line production of PCC for example so that carbon dioxide is introduced and mixed from the first injection mixer 24' or a series of mixers 24' on the first circumference 30 and lime milk is introduced from the second injection mixer 24" or series of mixers 24" on the second circumference 31. Naturally the introduction of said chemicals may also be arranged in opposite sequence, i.e. first the lime milk (Ca(OH)2) and then the carbon dioxide (CO2). It is also possible to locate said mixer stations in a staggered way onto the same circumference of the flow pipe, whereby the introduction and mixing of chemicals is effected simultaneously or both chemicals may be introduced with the same mixer station. In our tests we have noticed that without any kind of cleaning or anti-fastening systems a considerable layer of PCC fastens very quickly onto the wall of the flow pipe leading to the headbox, i.e. the reactor 10, causing the above-mentioned problems. PCC has a corresponding tendency to fasten to the tip part, the nozzle, of the injection mixer 24", which gradually, in addition to increasing the risk of removal of large PCC particles, also degrades both the introduction of chemicals from the nozzle and the penetration of the introduction jet and the evenness of the mixing.

When a test reactor according to FIG. 3, producing PCC, was provided with an electric cleaning system also according to FIG. 3, i.e. an electrode rod 16 centrally fastened to the reactor by means of arms 14 and 14', the inner surface of the reactor remained bright for the whole duration of the test runs, in other words the system could fully prevent carbonate from precipitating on the surface of the flow pipe. FIG. 3 shows a construction solution in which the electrode rod 16 extends essentially to the same diameter (circumference 30) as the first chemical injection mixer 24'. In most cases it would, however, be sufficient that the electrode rod extends from the diameter (circumference 31) of the injection mixer 24" introducing the second chemical to the direction of flow. When designing the cleaning system, it should however be noticed that the calcium carbonate naturally also tends to fasten to the arms 14 and 14' supporting the electrode rod 16. This may be prevented by at least two methods, i.e. either by manufacturing the arms of a material to which the carbonate crystals do not fasten or by arranging the arms outside the reaction zone, where on the one hand, at the location of the first, upstream arms, there so far is no calcium carbonate in crystallization phase, and on the other hand, at the location of the second, downstream arms, the carbonate crystals are no longer in an unstable form capable of being fastened.

Thus, the precipitation of calcium carbonate, used as a filler for papermaking, into the target suspension may be carried out by means of an in-line method directly in a process pipe leading to the headbox of the paper machine. In a reactor used for said purpose injection mixers or mixer stations for introducing both carbon dioxide and lime milk are preferably required. It is, naturally, also possible that one of the chemicals has been introduced into the target suspension already in a previous stage, possibly even by using a mixer of another type. However, here the injection mixing of at least the later introduced chemical makes it possible that the crystallization of PCC, i.e. the precipitated calcium carbonate, takes place at a very short distance in the process pipe. In other words, by reference to FIG. 1*a* and supposing that one of the chemicals (Ca(OH)2 and CO2 has already been introduced and mixed evenly enough into the target suspension already before the reactor 10, or by reference to FIG. 3 and supposing that the carbon dioxide and lime milk have first been introduced from the mixer 24' and the carbon dioxide or lime milk then from the mixer 24", the actual crystallization reaction of PCC may in practice commence immediately subsequent to the introduction point of the latter chemical.

Figure 4:
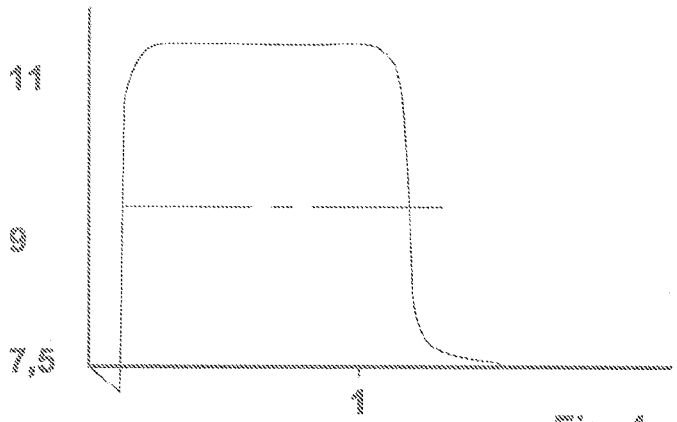
FIG. 4 shows the change of the pH value as a function of time when producing calcium carbonate from carbon dioxide and lime milk with a reactor shown in FIG. 3.

The plot in FIG. 4 shows the change of the pH value of the target suspension (vertical axis) as a function of time (horizontal axis, in seconds) when precipitating calcium carbonate into the target suspension with the reactor shown in FIG. 3. In the crystallization process schematically shown in the figure the carbon dioxide is first introduced into the target suspension (at the origin of the axes) whereby the pH value of the target suspension is somewhat lowered from the normal pH of about 7.5, depending on the amount of introduced carbon dioxide and the time between the introduction of carbon dioxide and the introduction of lime milk. Immediately after the start of the introduction and mixing of lime milk the pH value of the target suspension starts to increase and in practice it reaches its maximum value, a range of 11 to 12, wherefrom it quickly returns to a range of about 7.5 once the chemicals are used up in the crystallization reaction. In tests the chemicals, introduced in a stoichiometric relation to each other, were depleted in less than two seconds, even in less than about one and a half seconds. The requirement for such a fast crystallization reaction is that the mixing of the chemical/chemicals is essentially complete when using a correctly executed injection mixing (at least for the latter introduced chemical, preferably for both) and the Ca2+ and CO32− ions formed in the target suspension quickly find each other and react forming calcium carbonate crystals. Due to the very short total duration of the reaction the size distribution of the formed carbonate crystals is very even. According to some estimates it is typical for this kind of production reaction of PCC, as has already been briefly stated above, that immediately subsequent to the crystallization reaction the carbonate crystals are in such a phase, in other words in unstable crystal form prior to changing into calcite, that they tend to fasten to in practice any suitable solids particle or surface located nearby. In the target suspension such particles include fibers, various fine solids particles, filler particles and other carbonate crystals. Naturally also the walls of the flow pipe and other objects located in the flow pipe, such as the nozzles of the introduction and mixing means etc. are a good substrate for carbonate crystals to fasten to, whereby there are precipitations formed onto the surface of the flow pipe. In other words, carbonate precipitations are formed on the walls of the flow pipe and other structures only, when the crystal form is unstable, whereby the flow pipe may in practice be kept totally clean by preventing the unstable carbonate from precipitating onto the surface of the flow pipe as described above in some of the disclosed embodiments of the invention.

The above-mentioned strong change of pH value when introducing carbon dioxide and lime milk as the crystallization reaction progresses and especially as the crystallization reaction ends provides a possibility to follow the progress of the reaction by means of sensors measuring the above-mentioned pH value. If the sensor 22 is located as shown in FIGS. 1*a* and 3 to the level of the other end of the electrode rod, i.e. to the level of the end of the reactor, the pH value measured by the sensor 22 should be of the same order as before the introduction of the first chemical to avoid further formation of precipitations on the surface of the pipe. Thus, in case the pH value measured by means of a sensor located thus is considerably higher, the introduction/mixing parameters of the chemicals should be changed for improving the mixing efficiency of the chemicals. Naturally, there may be a number of such pH sensors along the length of the reactor (either on the wall of the reactor or on the electrode rod or both), whereby the change of the pH value gives a clear view of the progress of the crystallization reaction.

A solution in which the sensor measuring the pH of the suspension value arriving in the reaction zone of the reactor is located upstream in the reactor, whereby the control system receives up-to-date data about the pH value of the suspension arriving in the reactor. In fact, such a sensor should be located upstream of the chemical introduced first in order to find out the pH value of the fibrous suspension without the effect of the chemicals. When the relation of the carbon dioxide and lime milk introduced into the reactor subsequent to this sensor is kept stoichiometric by introducing the chemicals under control of flow metering, it is possible, if desired, to follow the progress of the crystallization reaction of the carbonate by means of the provided pH sensors. It is possible to correspondingly ensure at the end of the reactor that the crystallization reaction has ended. This is easy to verify by comparing the pH value at the end of the reactor to that measured before the reactor. If the values are equal, the chemicals have reacted in their entirety and there is no more risk of carbonate precipitating onto the surface of the pipe or the structures located therein.

Figure 5:
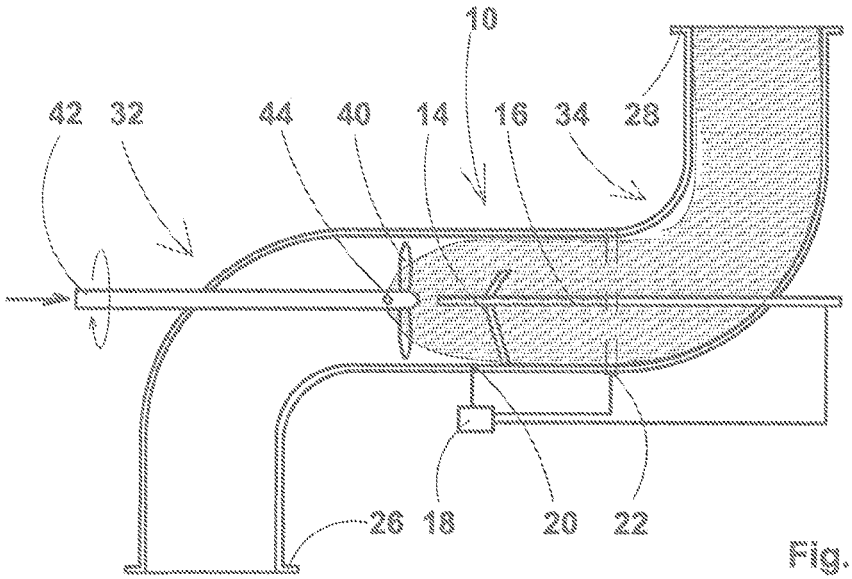
FIG. 5 shows a reactor according to a fourth embodiment of the present invention.

In a fourth embodiment of the invention, shown in FIG. 5, there are actually two separately applicable solutions. Firstly, the figure shows how the reactor according to the invention may also be provided with a mechanical mixer 40, subsequent to which there is relatively immediately the cleaning means with the electrode rod 16 and the arms 14, already shown in previous embodiments. In other words it is possible to introduce the chemical or chemicals to be mixed via the wall of the reactor 10 e.g. by injecting, as already described in earlier embodiments, but now in the vicinity of the mixer 40, whereby the mixer improves the already initiated mixing by injection. FIG. 5, however, shows as the second alternative how the chemical is introduced via the shaft tube 42 of the mixer 40 from holes 44 in the shaft to the process pipe, i.e. reactor 10, whereby the mechanical mixer 40 mixes the chemical further into the flow. It is additionally of course possible to bring the chemicals into the target suspension via both the mixer shaft, a separate axial and/or radial introduction pipe and from a conduit or an injection nozzle arranged on the wall of the flow pipe, in other words by one or more of the above-mentioned introduction methods.

As is apparent from one of the embodiments of the invention described above, the invention relates to an in-line mixing reactor in which carbon dioxide and lime milk are introduced and mixed into the target suspension and in which these are allowed to react with each other so that precipitation of the calcium carbonate crystals formed in the reaction on the various surfaces of the reactor, including the surfaces of the mixer, is avoided. The aim of the invention is to dimension the structure of the reactor and its functions so that practically the whole reaction has time to progress along the length of the reactor. Thus, mainly the effective length of the electrode rod is calculated as the length of the reactor. In other words, the aim is to extend the electrode rod to such a length in the process pipe along the flow direction of the target suspension that there are practically no more substances reacting with each other at the latter end of the electrode rod. As is also apparent from the above-mentioned embodiments, an efficient and even mixing leads to fast material transfer and fast reactions, so the adjustment of the mixing may have an effect on the required length of the reactor.

Even though the electrode rod has in the above been described as centrally installed in the flow pipe/reactor, it is in some cases possible to install it also in a slanted position in relation to the axis of the reactor. Such a solution is especially possible when the reactor/flow pipe makes a pipe elbow in which the reaction however progresses. In this case it is possible to arrange centrally extending electrode rods to the straight portions of the flow pipe on both sides of the pipe elbow with a still straight electrode rod between them in the pipe elbow, which is naturally preferably installed so that its effect on the cleaning of the area of the pipe elbow is the best possible. Especially with wide flow pipes it may be necessary to use a number of parallel electrode rods. Thus it is possible to make sure that the pH value of the liquid in the vicinity of the surface to be kept clean is on the desired range.

Figure 6:
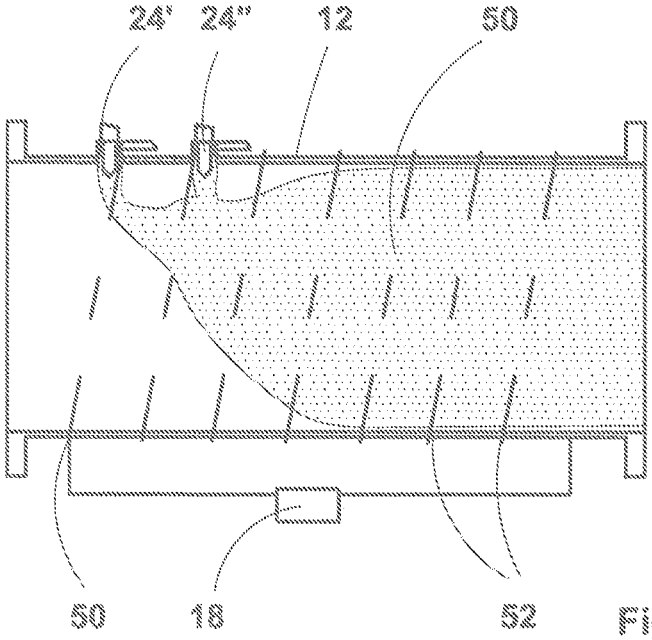
FIG. 6 shows a reactor according to a fifth embodiment of the present invention.

FIG. 6 shows very schematically, as a fifth embodiment of the present invention, another way of carrying out the crystallization reaction of the calcium carbonate so that carbonate is not allowed to attach to any surfaces located on the reaction zone. This other method is to arrange a permanent magnet or an electric magnet 50 around the flow pipe 12. Such apparatuses are disclosed in e.g. U.S. Pat. Nos. 5,725,778 and 5,738,766. The permanent magnet forms a magnetic field the direction and strength of which are constant. It is possible to arrange the electric magnet 50 in connection with the flow pipe e.g. by winding electric conductor 52 around the flow pipe 12 and directing an electric current into the coil formed thus. By changing the amplitude, direction and/or frequency of the electric current by means of the control unit 18 the direction and strength of the formed magnetic field may be changed as desired. It is additionally possible to direct electric current into the coil of the electric magnet 50 as waves of different shapes. However, whether the magnetic field is created by means of a permanent magnet or an electric magnet, the operation principle is always the same. An electric field is induced by the magnet inside the flow pipe. In order to be able to use said electric field the suspension flowing in the pipe must contain ions, in this case calcium ions and their counter ions (carbonate ions or hydrogen-carbonate ions). The electric field causes the ions in its range to be directed as required by their own charge in relation to the electric field. The mere existence of the electric field at a limited length in the flow pipe and especially the changes in the direction of the electric field turn the ions entrained with the flow as they tend to be directed according to the changes of the electric field, finally leading to the ionic bonds being released, with the ions being free to react with each other and to form calcium carbonate crystals. In other words, the electric field and especially its changes of direction accelerate the mutual chemical reaction of the ions, because the continuous changes of direction of the ions help their even mixing in the suspension. Additionally, the formed calcium carbonate crystals are immediately in such a phase that they may not be attached to the surfaces of the flow pipe and form precipitations or, if they form precipitations, they are so soft that they are immediately entrained in the flow with a suitable flow speed.

A third way, in itself different, of managing the crystallization reaction of calcium carbonate so that carbonate is not allowed to attach to any surfaces located in the reaction zone is, as has been mentioned in connection with the support arms of the electrode rod, to either produce such pieces, i.e. both the flow pipe and the structures located inside it, from such materials that carbonate crystals do not fasten to it. Polyamide may be mentioned as an example of such materials. Other possible coatings or manufacturing materials include PE resin, various polyurethanes, various fluoride compounds, such as Teflon®, waxes, silicones and epoxy resin. Further, various elastic rubbery compounds may be considered, including synthetic rubber or natural rubber, of which EPDM (ethylene propylene diene monomer) may be mentioned as an example. Additionally, similar results may be achieved with the topology of the surface (mostly by using a so-called nanosurface).

In the following, various alternative location positions of the PCC reactor in the short circulation are discussed with reference to FIGS. 7 to 14. It is previously known to produce PCC directly to the fibrous pulp flowing to the headbox of the fibrous web machine. This method has its own disadvantages, such as the target suspension being the whole of the fibrous pulp, whereby the precipitation of PCC may not be made especially with regard to a certain partial pulp or suspension. A further disadvantage is that all disturbances that may occur in the precipitation of PCC as in any partial process are directed to the process flow running directly to production. Thus, in most cases a disturbance in most cases directly affects the production.

Therefore, all solutions shown in the following images 7 to 14 relate to positioning the PCC reactor to a side flow, whereby it is on the one hand possible to precipitate PCC just into the target suspension yielding the most advantages, or on the other hand, the disturbances may be isolated without any effect on the production.

Figure 7:
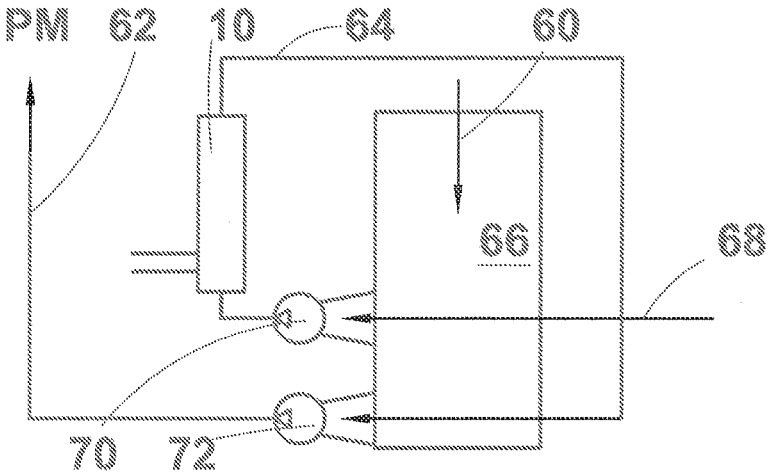
FIG. 7 shows the position of a PCC reactor according to a sixth embodiment of the present invention.

FIG. 7 shows schematically an apparatus according to a sixth embodiment of the present invention. In the apparatus of the figure the PCC reactor 10 has been moved from the line 62 leading to the fibrous web machine to its own line 64 in connection with the wire pit 66. Filtrates 60 are collected to the wire pit from e.g. the fibrous web machine. In the embodiment shown in the figure the high-consistency pulp 68, i.e. practically all pulp components needed for the production of the target suspension, the components including long-fiber pulp, short-fiber pulp, mechanical pulp, chemimechanical pulp, chemical pulp, microfiber pulp, nanofiber pulp, recycled pulp, reject, fines and fiber fraction from the fiber recovery filter, each of which may also be of one or more types, are directed to the dilution/mixing pump 70 wherein the high-consistency pulp is diluted from its original consistency of about 3% to 5% to between said consistency and the headbox consistency of about 0.5% to 1.8, preferably to a range of 0.5% to 2.5%, with the liquid from the wire pit. This intermediate diluted pulp is directed to the PCC reactor 10 in which carbon dioxide and lime milk are introduced into the pulp preferably by using injection mixer/mixers and in which PCC is crystallized from the carbon dioxide and lime milk on the fibers and other solids as described in the above-mentioned patent documents. The intermediate diluted PCC-loaded pulp is directed along pipe line 64 further to the wire pit 66 in which the PCC-loaded pulp is diluted to headbox consistency or near it using a dilution/mixing pump 72, subsequent to which the pulp is directed to the pipeline 62 leading to the fibrous web machine PM. In other words, the production of PCC takes place in a separate circulation, even though the target suspension is the fibrous pulp directed to the fibrous web machine.

Figure 8:
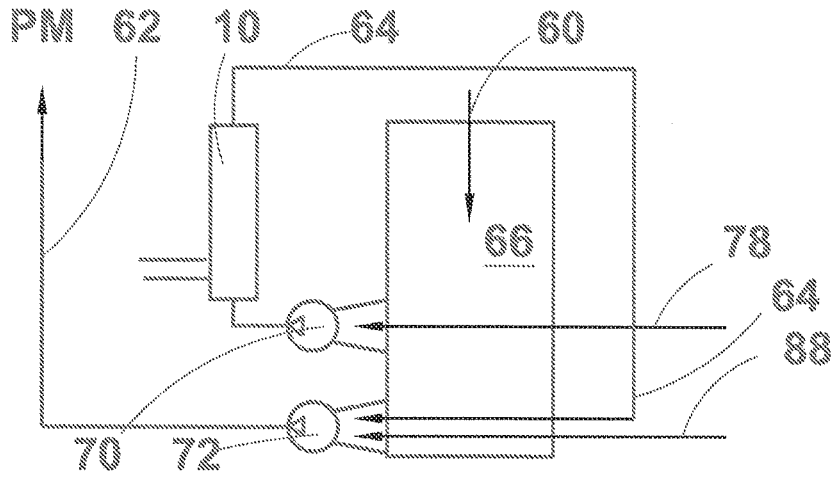
FIG. 8 shows the position of a PCC reactor according to a seventh embodiment of the present invention.

FIG. 8 is a schematic illustration of an apparatus according to a seventh embodiment of the present invention. In the apparatus of the figure the PCC reactor 10 has been moved from the line 62 leading to the fibrous web machine to its own line 64 in connection with the wire pit 66, similar to FIG. 7. In the embodiment shown in the figure one or more high-consistency pulp fractions or components 78 or filler components, but not the whole of the high-consistency pulp as in FIG. 7, is directed to the dilution/mixer pump 70 where said high-consistency pulp fraction 78 is diluted from its original consistency of about 3% to 5% to about between this consistency and the headbox consistency of 0.5% to 1.8%, preferably to 0.5% to 2.5% using liquid from the wire pit 66. This intermediate diluted pulp fraction is directed into the PCC reactor 10, where PCC is precipitated from lime milk and carbon dioxide onto the surface of the fibers as described in the above-mentioned patent applications. The PCC-loaded intermediate diluted pulp is directed along pipeline 64 again to the wire pit 66, in which the PCC-loaded pulp and the remaining fractions 88 of the high-consistency pulp brought into contact therewith are by means of the dilution/mixing pump 72 mixed with the PCC-loaded pulp and diluted to headbox consistency or near it and directed to the pipe line 62 leading to the fibrous web machine PM.

Figure 9:
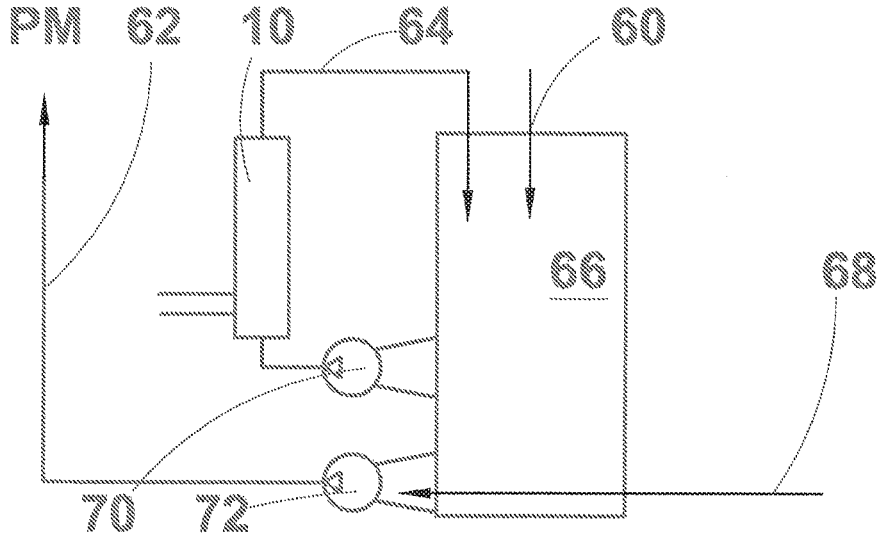
FIG. 9 shows the position of a PCC reactor according to an eighth embodiment of the present invention.

FIG. 9 is a schematic illustration of an apparatus according to a eighth embodiment of the present invention. In the apparatus of the figure the PCC reactor 10 has been moved from the line 62 leading to the fibrous web machine to its own line 64 in connection with the wire pit 66, similar to FIGS. 7 and 8. In the embodiment of the figure the recycling pump 70 pumps only at least the filtrate 60 directed from the fibrous web machine to the wire pit 66 via the PCC reactor 10 back to the wire pit 66. In other words, PCC is precipitated to the solids of the filtrate, which mainly comprise both fine fibrous material and filler. In the embodiment of the figure the PCC-loaded filtrate is used for diluting the high-consistency pulp 68, i.e. practically all pulp components needed for the production of the target suspension, these including among others long-fiber pulp, short-fiber pulp, mechanical pulp, chemimechanical pulp, chemical pulp, microfiber pulp, nanofiber pulp, recycled pulp, reject, fines and fiber fraction from the fiber recovery filter, each of which may be of one or more types, to headbox consistency or near it by means of the dilution/mixing pump 72, subsequent to which it is directed to the pipeline 62 leading to the fibrous web machine PM.

Figure 10:
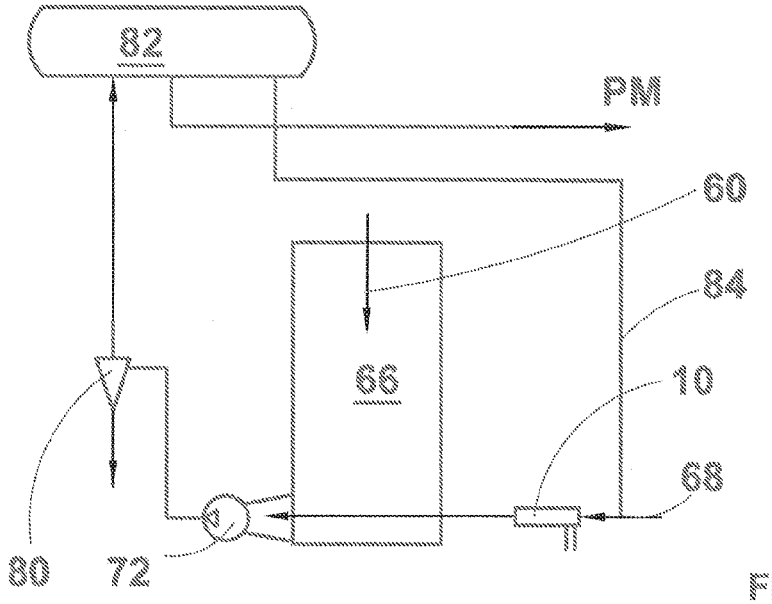
FIG. 10 shows the position of a PCC reactor according to a ninth embodiment of the present invention.

FIG. 10 is a schematic illustration of an apparatus according to a ninth embodiment of the present invention. In the embodiment of FIG. 10 the approach system of the fibrous web machine is described in slightly more detail in the context of a vortex cleaning (vc) plant 80 using one vortex cleaner. Thus, in said approach system the filtrate arriving to the wire pit 66 from the fibrous web machine 60 is used to dilute the target suspension to headbox consistency by means of feed pump 72 and it is pumped via the vc plant 80 (sometimes also directly, if the approach system does not include a vc plant) to the gas separation tank 83, a so-called deculator, from which the gas-free target suspension is directed to the fibrous web machine PM. The surface level of the gas separation tank 82 is kept constant by means of an overflow weir so that the target suspension removed from the tank as overflow is returned back to the process along line 84. In the embodiment of FIG. 10 this overflow return is taken to the high-consistency pulp 68 so that the whole of the high-consistency pulp is diluted with said overflow suspension. The diluted mixture of overflow and high-consistency pulp is directed to the feed pump 72 in connection with the wire pit 66 only after said dilution, in connection with which the pulp is diluted to headbox consistency or near it.

Figure 11:
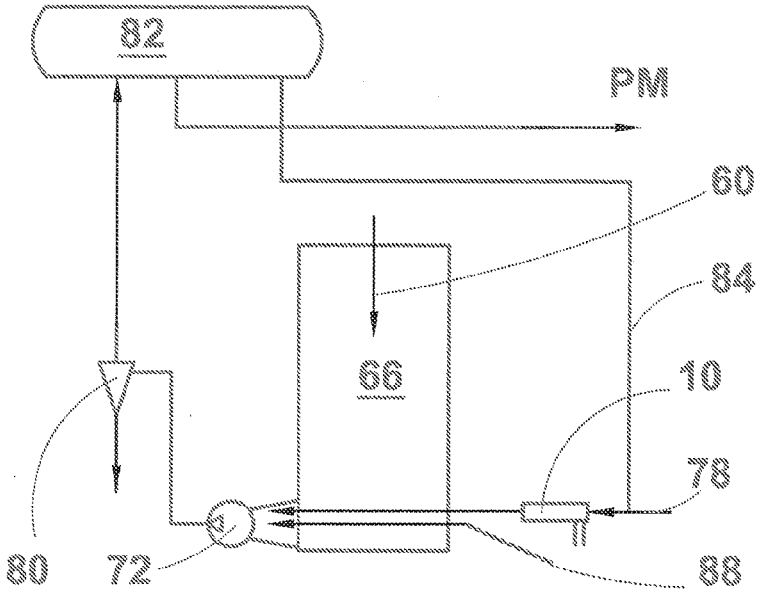
FIG. 11 shows the position of a PCC reactor according to a tenth embodiment of the present invention.

FIG. 11 is a schematic illustration of an apparatus according to a tenth embodiment of the present invention. In this embodiment the approach system of a fibrous web machine is shown as in FIG. 10 so that the vortex cleaning plant 80 is described using one vortex cleaner. Thus, in said approach system the filtrate arriving to the wire pit 66 from the fibrous web machine 60 is used to dilute the target suspension to headbox consistency by means of feed pump 72 and it is pumped via the vc plant 80 (sometimes also directly, if the approach system does not include a vc plant) to the gas separation tank 82, a so-called deculator, from which the gas-free target suspension is directed to the fibrous web machine PM. The surface level of the gas separation tank 82 is kept constant by means of an overflow weir so that the target suspension removed from the tank as overflow is returned back to the process along line 84. In the embodiment of FIG. 11 this overflow return is taken into the high-consistency pulp so that one or more fiber or filler component of the high-consistency pulp 78 is diluted with said overflow suspension. The diluted mixture of overflow and high-consistency pulp component/s 78 is directed only after said dilution to the feed pump 72 in connection with the wire pit 66, the rest of the high-consistency components 88 being brought to the feed pump 72, in connection with which the pulp is diluted to headbox consistency or near it.

Figure 12:
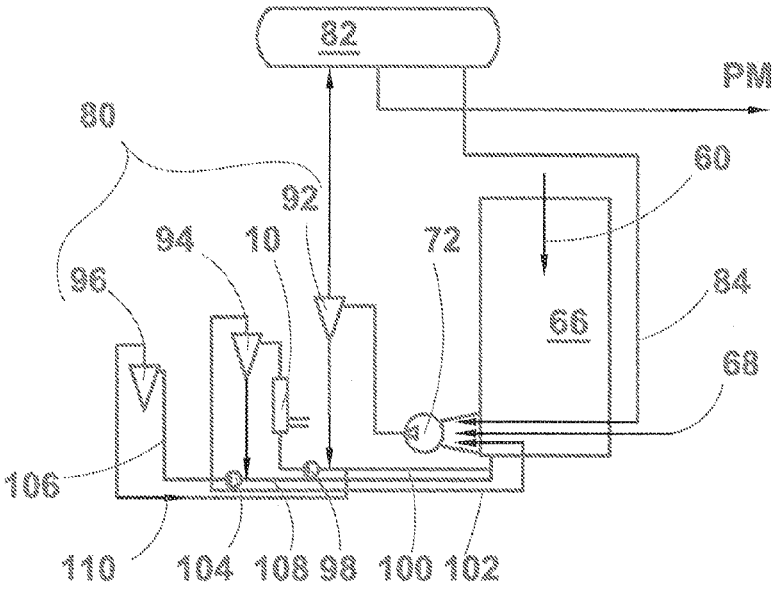
FIG. 12 shows the position of a PCC reactor according to an eleventh embodiment of the present invention.

FIG. 12 is a schematic illustration of an apparatus according to an eleventh embodiment of the present invention. The figure illustrates the approach system of a fibrous web machine in more detail than previously. It has e.g. been suggested that the target suspension comprising various high-consistency components 68 and diluted in connection with the wire pit 66 is pumped with pump 72 to a vortex cleaning plant 80 which in this case consists of three stages 92, 94 and 96, even though the number of stages may in reality be even larger. The accept, i.e. overflow of the first stage 92 of the vortex cleaning plant is directed directly to the fibrous web machine or, as shown in the figure, to the gas separation tank 82, the deculator, from which the essentially gas-free fraction is directed to the fibrous web machine PM and the portion of the target suspension removed over the overflow weir maintaining a constant surface level in the gas separation tank 82 is returned along line 84 to the introduction of the pump 72, in most cases in connection with the wire pit 66. The reject of the first stage 92 of the vortex cleaning plant 80, i.e. underflow, is directed to the second stage 94 of the vc plant by means of pump 98. Usually there also is a dilution liquid line 100 from the wire pit 66 leading to the pump 98. In this embodiment of the invention the PCC reactor 10 is located into the feed of the second stage 94 of the vc plant 80. In the second vc stage 94, i.e. subsequent to the crystallization and precipitation of PCC onto solids, the target suspension is divided into two fractions from which the overflow is directed along line 102 to the inlet of pump 72, usually in connection with the wire pit 66, from which it is transported via the first stage 92 of the vc plant 80 and the gas separation tank 82 to the fibrous web machine PM. The reject, i.e. underflow, of the second stage 94 of the vc plant 80 is directed by pump 104 along line 196 to the third stage 96 of the vc plant 80, usually diluted with wire water arriving from the wire pit 66 along line 108. The accept of the third stage 96 of the vc plant is usually taken along line 110 to the introduction of the second stage 94 of the vc plant, i.e. in practice in this embodiment of the present invention PCC is precipitated, in addition to the reject of the first stage of the vc plant, also to the accept of the third stage.

One of the advantages of this embodiment, actually also of the following embodiment, is that in case during the crystallization of PCC is precipitated into the actual reactor or the subsequent pipeline, the precipitate being then every now and then released as larger particles, the particles are separated already in the second stage 94 of the vc plant 80 into the reject and do not affect the production of the fibrous web.

Figure 13:
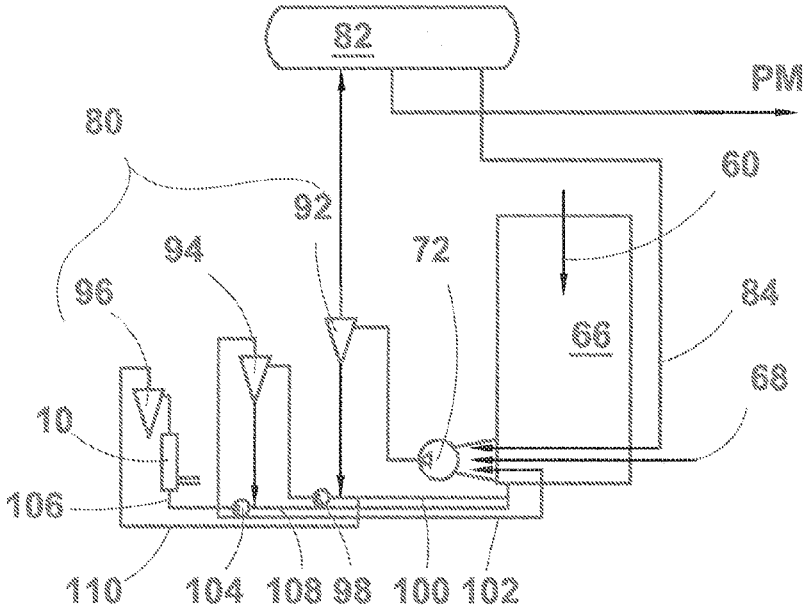
FIG. 13 shows the position of a PCC reactor according to a twelfth embodiment of the present invention.

FIG. 13 is a schematic illustration of an apparatus according to a twelfth embodiment of the present invention. Like FIG. 12, this figure illustrates the approach system of a fibrous web machine in some more detail. It has e.g. been suggested that the target suspension comprising various high-consistency components 68 and diluted in connection with the wire pit 66 is pumped with pump 72 to a vortex cleaning plant 80 which in this case consists of three stages 92, 94 and 96, even though the number of stages may in reality be even larger. The accept, i.e. overflow of the first stage 92 of the vortex cleaning plant is directed directly to the fibrous web machine or, as shown in the figure, to the gas separation tank 82, the deculator, from which the essentially gas-free fraction is directed to the fibrous web machine PM and the portion of the target suspension removed over the overflow weir maintaining a constant surface level in the gas separation tank 82 is returned along line 84 to the inlet of the pump 72 pumping target suspension towards the vc plant, in most cases in connection with the wire pit 66. The reject of the first stage 92 of the vortex cleaning plant 80, i.e. underflow, is directed to the second stage 94 of the vc plant 80 by means of pump 98. Usually there's also a dilution liquid line 100 from the wire pit 66 leading to the pump 98. In the second vc stage 94 the target suspension is divided into two fractions from which the accept, i.e. overflow is directed along line 102 to the feed of the feed pump 72, usually in connection with the wire pit 66, wherefrom it is transported via the first stage 92 of the vc plant 80 and the gas separation tank 82 to the fibrous web machine PM. The reject, i.e. underflow, of the second stage 94 of the vc plant 80 is directed by pump 104 along line 196 to the third stage 96 of the vc plant 80, usually diluted with wire water arriving from the wire pit 66 along line 108. In this embodiment the PCC reactor 10 is located in the introduction of the third stage 96 of the vc plant 80 so that the PCC produced in reactor 10 and being accepted in the stages of the vc plant is first transported along line 110 to the inlet side of the pump 98 of the introduction of second stage 94 of the vc station 80, then from the second stage along line 102 to the feed pump 72 and from there further to the gas separation tank 82 and finally to the fibrous web machine PM.

Figure 14:
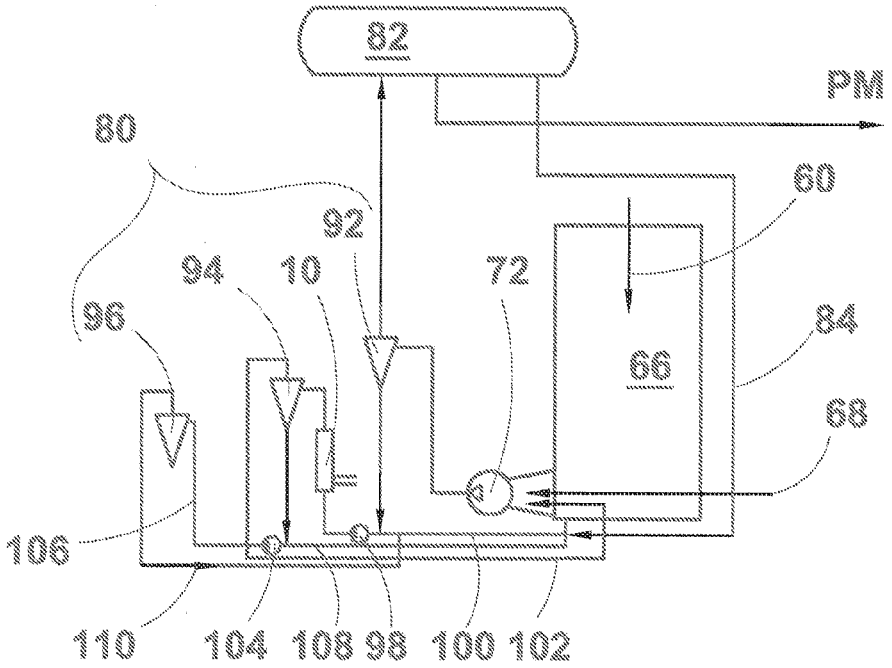
FIG. 14 shows a flow connection associated with the reactor according to a thirteenth embodiment of the present invention.

The arrangement shown in FIG. 14 may be mentioned as yet another, thirteenth, embodiment of the present invention, the arrangement being otherwise of a similar type as the embodiment of FIG. 12, but here the overflow of the gas separation tank 82 is not directed to the pump 72 in connection with the wire pit 66, but it is instead directed to the feed pump 98 of the second stage 94 of the vc plant 80. In other words, the overflow may be used either alone or together with the wire water available from the wire pit 66 along line 100 for adjusting the consistency of the reject of the first stage 92 and the accept of the third stage 96 of the vc plant so as to suit the PCC reactor 10. Filtrate from the white water filter may also be used for said consistency adjustment.

Figure 15:
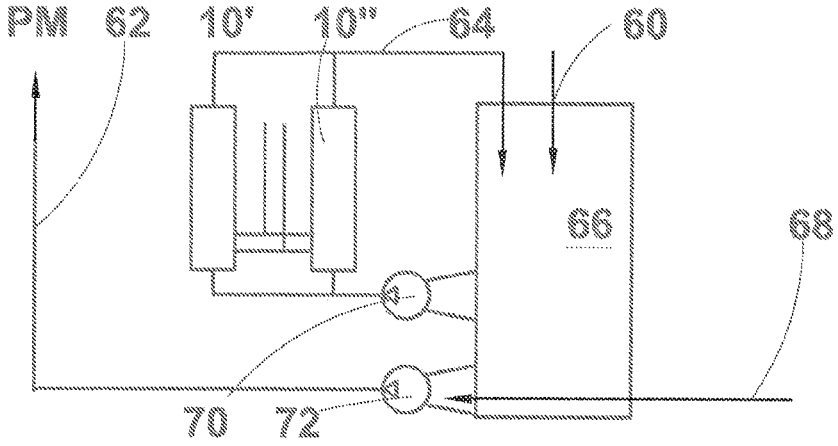
FIG. 15 shows a flow connection associated with the reactor according to a fourteenth embodiment of the present invention.

Finally, FIG. 15 illustrates as a fourteenth embodiment of the invention a solution for preventing the disadvantageous effects of PCC precipitations in the PCC reactor. Said solution is based on the use of (at least) two parallel reactors 10' and 10" so that mainly only one of the reactors is in actual production use while the other is being cleaned. This may be carried out so that each reactor 10', 10" is connected to the pipeline 64 by valves (not shown) so that the reactors may be connected to the PCC production and disconnected therefrom as desired. In other words, according to an advantageous additional embodiment, when the PCC production is to be changed from one reactor to another the valves of the first reactor (inlet and outlet valves) are being closed while simultaneously opening the valves of the second reactor, whereby the aim is naturally to achieve a constant volume flow through reactors 10' and 10". The flows of the chemicals introduced into the reactors 10' and 10" are correspondingly adjusted by their own valves (not shown) in order to keep the PCC concentration even/as desired in the suspension to be formed. When the production of PCC has totally been transferred to the second reactor and the first reactor is disconnected from the production circulation 64 of PCC, an acid solution of suitable strength is directed into the first reactor for quickly dissolving the PCC attached to the walls of the reactor and the chemical introduction means. The frequency of the above-mentioned cleaning sequence may be determined either by experience or by using a suitable electric method (tomography, resistance over the layered PCC or the like). Usually the reactors need to be cleaned, depending on the application, with intervals ranging from a few days to a few weeks.

It should be noted about the fourteenth embodiment above that even though the used pair of reactors 10', 10" is shown in just a certain position in the approach system of the fibrous web machine, it may be positioned in any place of the process where also a single PCC reactor could be positioned.

Finally, it should be noted that only a few of the most embodiments of the invention are disclosed above. Thus, it is obvious that the invention is not limited to the above-mentioned embodiments but it may be applied in many ways within the scope defined by the appended claims. It is, for example, obvious that the definition of target suspension used in connection with the various embodiments of the invention is only to be understood as an example. It is thus obvious that as the aim of the invention is in-line production of PCC into the short circulation of a fibrous web machine, the introduction of the chemicals and thus also the production of PCC may be carried out, in addition to the pulp itself, to any fraction or suspension used in the production of pulp directly or indirectly. Thus carbon dioxide and lime milk may be introduced and so the PCC may be produced into a fiber fraction (e.g. long-fiber pulp, short-fiber pulp, mechanical pulp, chemical pulp, recycled pulp, fines) or filler fraction (e.g. TiO2) or a fibrous filtrate. Various filtrates coming from the actual fibrous web machine (wire/press section), the cloudy and clear filtrates from the fiber recovery filter as well as filtrates being introduced into various dilution targets, such as headbox, may be mentioned as examples of the filtrates. The chemicals may further be introduced into, for example, a stage in a vortex cleaning plant, the overflow of which is imported into the target suspension. Thus the term "flow pipe" used above must also be understood not only as a flow conduit for pulp towards the headbox of the paper machine, but also as a flow conduit for said partial pulps, suspensions, components or fractions in which they are directed towards the final production of paper. It is yet to be understood that even if the wire pit is shown as a traditional cylindrical tank in FIGS. 7 to 15 above, the production of PCC according to the invention may also be carried out into novel type of wire pit formed of a wide-area shallow vessel and an overflow pipe exiting therefrom. Thus the production of PCC may be advantageously carried out into the outlet pipes of said wire pit in the whole of the white water volume or nearly the whole of the white water volume.

It is further to be noticed that even if in the above fibrous pulp, its partial pulps and other suspensions and filtrates used in the production of fibrous pulp has been mentioned in some contexts, target suspension means all kinds of suspensions used in one way or the other in various production steps of the fiber components used for the production of a fibrous web. Thus the invention relates to, in addition to normal paper machines, also to e.g. various tissue and board machines. The features disclosed in connection with various embodiments may also be used in connection with other embodiments within the inventive scope and/or different assemblies may be combined from the disclosed features, should it be desired and should it be technically feasible.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A method for production of calcium carbonate in a target suspension of a fibrous web forming process of a fibrous web machine, the target suspension comprising at least one of virgin pulp suspension, recycled pulp suspension, additive suspension and solids-containing filtrate, wherein the calcium carbonate is produced in a reactor having a flow pipe transporting the target suspension and the reactor includes a first electrode in and extending in the flow pipe along a direction of the flow of the target suspension and a second electrode on or incorporated in a surface of the reactor adjacent the flow pipe and the second electrode extending the length of the flow pipe, wherein the first electrode and the second electrode are isolated from each other and each exposed to the target suspension in the flow pipe, the method comprising:

injecting a chemical including at least one of carbon dioxide and lime milk through at least one injection mixer to said target suspension as said target suspension flows through the flow pipe of the reactor;

allowing said chemical to react while in the target suspension to form calcium carbonate crystals, and inhibiting precipitation of the chemical or a reaction product of the chemical on the surface of or in the reactor by application of an electric or magnetic field to or proximate to the surface along a region of the surface adjacent to the reaction involving the chemical by:

applying a direct current (DC) to the first electrode and the second electrode, wherein the polarity of the DC causes one of the first electrode and the second electrode to be a cathode and the other of the first electrode and the second electrode to be an anode, periodically switching the polarity of the DC such that one of the first electrode and the second electrode become the anode while switching the other of the first electrode and the second electrode becomes the cathode.

2. The method according to claim 1 wherein the switching is in response to a voltage difference between the first electrode and the second electrode exceeding a reference value.

3. The method according to claim 2, wherein the switching is in response to a voltage difference between the first electrode and the second electrode falling to less than the reference value and the switching results in the second electrode being the cathode and the first electrode being the anode.

4. The method according to claim 3, wherein the direct current is from a current source having alternating polarity.

5. The method according to claim 4 wherein the switching periodically occurs at certain time intervals each of which is at least a one second interval.

6. The method according to claim 4, wherein the switching occurs in response to a voltage difference between the electrode rod and said at least one electrode exceeding a reference value.

7. The method according to claim 6, wherein a second switching occurs when the voltage difference is less than the reference value, wherein the second switching the first electrode to function as the cathode while switching the second electrode to function as the anode.

8. The method according to claim 1 wherein the step of inhibiting uses a permanent magnet or an electric magnet arranged on the reactor.

9. The method according to claim 8 wherein the electric magnet includes a conductive coil around the reactor and connected to a current source.

10. The method according to claim 9 wherein the current source is a source of an electrical current having alternating polarity or current level.

11. The method according to claims 1 further comprising monitoring the propagation of the crystallization reaction using at least one of a pH sensor, conductivity sensors or by tomography imaging.

12. A method for treating a target fibrous suspension flowing in a fibrous web forming process, the method comprising:

introducing a chemical including at least one of carbon dioxide and lime milk through at least one injection mixer to the target suspension as the target suspension flows through a flow pipe in the reactor;

forming calcium carbonate crystals in the target suspension based on a reaction in the target suspension involving the chemical;

establishing an electric field on a surface of the flow pipe by applying a direct current across a first electrode on or embedded in the surface and a second electrode in the flow pipe, wherein the first electrode and the second electrode extend a length of the flow pipe, wherein the polarity of the direct current causes the first electrode to be an anode and the second electrode to be a cathode, and periodically switching the polarity of the direct current applied to the first and second electrodes, wherein an interval is at least a second between the switching and during which the first electrode is the anode and the second electrode is the cathode.

* * * * *